United States Patent [19]

Camarero

[11] 4,003,509

[45] Jan. 18, 1977

[54] DISPOSABLE BATH TOWEL AND DISPENSING DEVICE

[76] Inventor: George L. Camarero, 3304 93rd St., Jackson Heights, N.Y. 11372

[22] Filed: July 10, 1975

[21] Appl. No.: 594,949

[52] U.S. Cl. ..... 225/23; 225/67

[51] Int. Cl.[2] ..... B26F 3/02

[58] Field of Search ..... 225/23, 24, 67, 68, 225/69, 70, 71, 76, 79, 82, 84, 85, 91; 162/141, 148; 242/67.1 R, 67.1 D; 428/85, 90, 91, 43, 88

[56] References Cited

UNITED STATES PATENTS

| | | | |
|---|---|---|---|
| 365,334 | 6/1887 | Drosten | 225/71 |
| 518,878 | 4/1894 | Danois | 428/90 X |
| 1,117,404 | 11/1914 | Krue | 225/23 |
| 1,216,950 | 2/1917 | Conner | 225/23 |
| 1,512,849 | 10/1924 | Isham | 225/67 |
| 1,606,774 | 11/1926 | Nelson | 225/67 X |
| 2,256,342 | 9/1941 | Hope | 225/67 |
| 2,734,692 | 2/1956 | Robinson | 242/67.1 R X |
| 2,859,150 | 11/1958 | Toulmin | 428/90 |
| 3,510,081 | 5/1970 | Anderson | 242/67.1 D |

FOREIGN PATENTS OR APPLICATIONS

| | | | |
|---|---|---|---|
| 254,284 | 7/1927 | Italy | 225/67 |

*Primary Examiner*—Frank T. Yost

[57] ABSTRACT

In a preferred embodiment, a series of absorbent tear-off elongated sheets of paper imprinted to have opposite ends with simulated borders and having felted absorbent fibers extending from the printed surface along the length of the respective sheets with multicolored zones resembling quality textile cloth toweling, with the series of sheets rolled and mounted for cranking forwardly beneath a spring-biased roller to a position beneath a tear-blade, such that the disposable simulated bath towel sheets might be cranked to a tear-off position one at a time and torn-away for use as a conventional bath towel to be hung in a bath room or used as such, or as a beach towel.

1 Claim, 3 Drawing Figures

DISPOSABLE BATH TOWEL AND DISPENSING DEVICE

This invention relates to a disposable paper towel for use as a bath towel.

BACKGROUND OF THE INVENTION

Prior to the present invention, there has not existed any toweling suitable for formal bath room use in either the home or in motels or hotels. Commercial paper towels to present have all had the inexcapable appearance of cheap paper toweling to be utilized solely as a matter of convenience and clearly not for use where an appearance of quality and fineness might be desired.

SUMMARY OF THE INVENTION

Objects of the present invention include the overcoming of disadvantages of prior disposable toweling, together with the development of an entirely new field of use for such absorbent disposable toweling, by the present invention together with novel articles and devices thereof.

Another object is to obtain a novel toweling of a disposable nature highly simulative of high quality bath and/or beach toweling.

Another object is to obtain a toweling having both an appearance at close inspection and a feel of quality cloth fabric toweling.

Another object is to obtain a disposable paper toweling simulative of high quality bath toweling at low cost of production thereof.

Another object is to obtain a suitable device for effective advancing of the tear-off sheets thereof serially to and beneath tear-off points, for neat and clean-cut tear-availability of each sheet one at a time from a roll thereof.

Other objects become apparent from the preceding and following disclosure.

One or more objects are obtained by the invention defined herein.

Broadly the invention may be defined as a simulative paper toweling of elongated shape as bath and/or beach toweling having on at least one and preferably both of opposite faces thereof imprinting of border at each of the opposite ends or of opposite sides thereof, or both, to give the appearance of seaming, together with preferably color zones(s) as with conventional high quality toweling, with felting (with or without surface coating material on the sheet face) extending from the sheet as fine paper fibers which may be obtained by partially shredding the surface of the sheet abrasively and/or by applying adhesively felt paper fibers of high absorbency. Accordingly, not only does the toweling have the advantage of being disposable but of grand high quality appearance and feel making it practical for use in the best of homes and hotels, motels, trailers(travel-trailers), hospitals and the like, but additionally the individual towels are highly absorbent for large quantities of water since also the felted paper fibers are absorbent of droplets of water. Also , the felting adds softness to the face of the paper and additional body, such that even during use thereof there is the advantage of good absorbency together with good and comfortable feel to the skin of the person.

In a preferred embodiment, individual sheets are joined to one-another serially as a continuous sheet so-produced with preferably a scoring and/or line of perforation, providing for easy tear of one sheet from another.

For quality disposable toweling of the present invention, however, the ease of clean cut tearing is important, and accordingly there is provided as a part of the combination a mounting for a roll of the serially arranged consecutive sheet, with a roller and with a tear-blade each mounted on a common base on which the roll of towels are supported, with the roller and the tear blade each being biased by a spring forwardly toward the center of the roll such that a crank provided at the end of the roll may effectively crank forwardly and thereby advance a sheet at a time of the roll beneath the roller and eventually from beneath the tear-blade until the tear point reaches the tear-blade at which time the person would grasp the edge of the towel sheet and pull tearingly along the tear-blade to thereby shear-off the sheet from the remaining sheets of the roll.

The invention may be better understood by making reference to the following Figures.

THE FIGURES

FIG. 1 illustrates in perspective top side view a preferred embodiment of the invention in an in-part-view of a plurality of simulative toweling sheet interconnected by partially severed and/or scored portions between the imprinted towel-ends, as it would appear in this embodiment between adjacent end borders of consecutive adjacent sheets, with zones dyed or printed thereon and with a felted finish on the top and bottom thereof.

DETAILED DESCRIPTION OF THE INVENTION

In addition to the matters noted above, it should be apparent that conventional or desired surface coatings and compositions may be utilized to add the feel of bulk and softness to the surfaces of the paper toweling of the present invention, as well as any other conventional desired additional treatments.

Also, the terms "imprint" or "imprinted" or "imprinting" each are intended to be, for purposes of this disclosure, the same as dying or coloring or the like.

Figure 1:
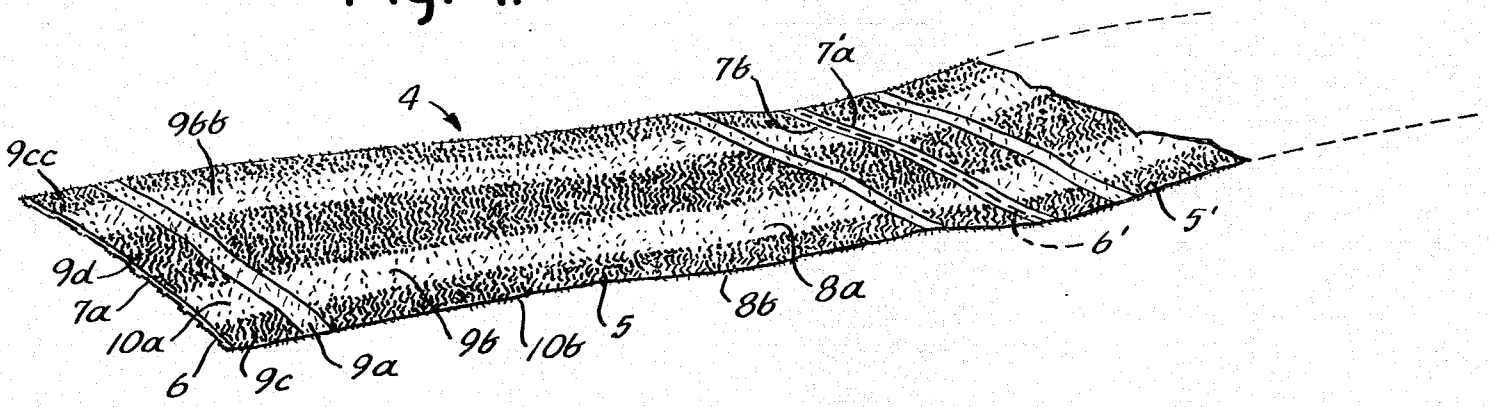

With reference to the Figures, FIG. 1 illustrates an in-part view of a series of disposable simulative toweling sheets of the present invention, broadly designated continuous strip 4, of consecutive sheets or individual towels 5 and 5' , from which a prior-torn towel has been sheared/torn at the tear point 6, with the partially-sheared (or scored — equivalent, for purposes of this invention) tear line between sheets 5 and 5' being at point 6' half-way between printed borders **7*b* and 7'*a*. The printed borders at opposite ends of the length of the sheet 5 are the identified borders 7*a* and 7*b* respectively, simulative of seamed ends of the towel, for example. The sheets have characteristically an upper surface 8*a* and a lower surface 8*b*, both surfaces being felted in this embodiment as illustrated as upper felting 10*a* and lower felting 10*b*. The towel sheet (each respectively) has printed thereon different zones as conventional high quality towels, as zones 9***a*, 9*b*, 9*bb*, 9*c*, 9*cc*, and centrally 9*d*.

Figure 3:
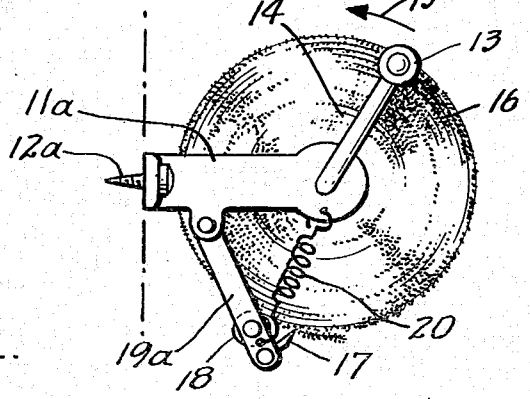
FIG. 3 is a view in elevation taken along lines 3—3 of FIG. 2, of the device and roll of FIG. 2, of the invention.
Figure 2:
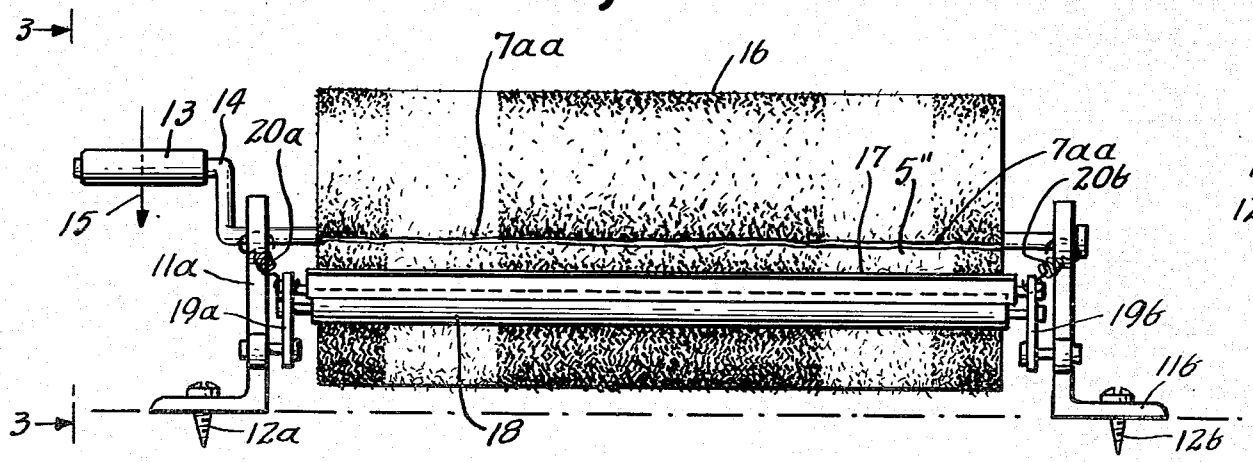
FIG. 2 illustrates a typical preferred embodiment of the dispensing device including a mounting base mounting the roll of towels and spring biasing a roller-carrying and tear-blade-carrying lever arm toward the roll, shown in upright side view thereof.

A roll 16 of the series 4 are mounted on a mounting structure 11*a* and 11*b* securable to a wall typically by screws 12*a* (or by any equivalent means as an adherable element). A handle 13 is available to crank a crank 14 in direction 15 (see FIGS. 2 and 3) to thereby rotate the roll 16 beneath the downwardly biased tearblade 17 and roller 18 both mounted between the pivoted lever arms 19*a* and 19*b* biased respectively by springs 20 and 20*b*.

It is within the scope of the present invention to make such variations and modifications and substitutions of equivalents as would be apparent to a person of ordinary skill.

I claim:

1. A disposable bath towel combination comprising in combination: a sheet of fibrous paper of a predetermined elongated length characterized by a predetermined high degree of absorbency for water, having imprinted thereon at least one face thereof bath towel-simulated border edging extending transversely along an axis of a width thereof at at-least each of two opposite ends of the elongated length of the sheet, adapted thereby as a bath or beach towel of a disposable nature, the absorbent fibers being substantially felted to said face, said face having imprinted thereon a predetermined bath towel multicolored zone extending axially in parallel along said elongated length adapted such that appearance thereof corresponds to a fabric cloth material bath towel of conventional cloth nature, and a series of said sheet in end-to-end relationship linked detachably by scored tear-lines between adjacent ones of towel-simulated border of serially consecutive sheets, and adapted for feeding said series a feed means mounting the series, the feed means being for facilitating an advancing and tearing-off one at a time of said sheet from the series, the series being lengthwise-axis rolled into a roll, the feed means being un-rollable of a roll of the series mounted thereon, the feed means comprising two spaced-apart pivotably mounted support arms substantially in parallel at opposite ends of a roll of a width of said series, with a roller mounted adjacent said roll, on and extending between the support arms at points intermediate lengths of the support arms, and with a knife-edge structure biased against said one face; and the roll being positioned mounted revolvably adapted for a cranking of the series beneath said roller to thereby unroll the series to a tear-point of the scored tear-lines, said feed means further including lever structure mounted and adapted to revolve the roll beneath the roller and the knife-edge structure, the roller and the knife-edge structure being in substantially parallel and side-by-side relationship to one-another such that the sheet next-occuring to be next torn-away is held flushly against lower layers therebeneath sheets of the roll when the knife-edge structure is biased against the scored tear-lines of a hanging terminal sheet ready to be torn from the roll, and the feed means further including spring structure mounted and adapted to pivotably bias the support arms and the roller and the knife-edge structure inwardly toward the roll, and said lever structure including a crank mounted and adapted for revolving said roll.

* * * * *